US007448507B1

(12) United States Patent
Abernathy, Jr.

(10) Patent No.: US 7,448,507 B1
(45) Date of Patent: Nov. 11, 2008

(54) ADJUSTABLE MOUNTING DEVICE

(76) Inventor: Henry H. Abernathy, Jr., 139 E. 66th St., Apt. 5N, New York, NY (US) 10021

( * ) Notice: Subject to any disclaimer, the term of this patent is extended or adjusted under 35 U.S.C. 154(b) by 0 days.

(21) Appl. No.: 11/787,824

(22) Filed: Apr. 18, 2007

(51) Int. Cl.
*A47F 5/08* (2006.01)

(52) U.S. Cl. ..... 211/90.01

(58) Field of Classification Search ..... 248/495, 248/496; 211/90.01, 86.01, 87.01, 175, 183
See application file for complete search history.

(56) References Cited

U.S. PATENT DOCUMENTS

| | | | | |
|---|---|---|---|---|
| 521,291 | A | 6/1894 | Lynch | |
| 717,859 | A | 1/1903 | Jackson et al. | |
| 779,433 | A | 1/1905 | Long | |
| 779,443 | A | 1/1905 | Long | |
| 791,060 | A * | 5/1905 | Wallace | 248/496 |
| 904,690 | A * | 11/1908 | Francis | 248/496 |
| 935,797 | A * | 10/1909 | Leonard | 248/496 |
| 1,107,686 | A * | 8/1914 | Mehrmann | 248/495 |
| 1,229,221 | A | 6/1917 | Bugele | |
| 1,951,583 | A | 3/1934 | Swanson | |
| 2,139,309 | A | 12/1938 | Linden | |
| 2,532,162 | A | 11/1950 | Goss | |
| 2,681,194 | A | 6/1954 | Halvorsen | |
| 2,696,962 | A | 12/1954 | Goss | |
| 2,740,603 | A | 4/1956 | Wofford | |
| 2,952,431 | A | 9/1960 | Pedley | |
| 2,975,994 | A | 3/1961 | Goss | |
| 2,987,832 | A | 6/1961 | Urbain et al. | |
| 3,724,085 | A | 4/1973 | Wentworth | |
| 4,033,539 | A | 7/1977 | Bardocz | |
| 4,340,199 | A | 7/1982 | Brock | |
| 4,892,284 | A | 1/1990 | Kelrick | |
| 5,069,411 | A | 12/1991 | Murphy | |
| 5,201,487 | A | 4/1993 | Epplett | |
| 5,342,014 | A | 8/1994 | Wilson | |
| 5,584,462 | A | 12/1996 | Reese | |
| 5,732,912 | A | 3/1998 | Nomura et al. | |

(Continued)

FOREIGN PATENT DOCUMENTS

| | | |
|---|---|---|
| GB | 1 513 821 | 6/1978 |

(Continued)

*Primary Examiner*—Sarah Purol
(74) *Attorney, Agent, or Firm*—David M. Quinlan, P.C.

(57) ABSTRACT

A device for hanging an object on a supporting structure such as a wall comprises a one-piece backing plate having a plurality of co-planar bars extending between co-planar side rails and forming slots between the bars, with the backing plate including offset shoulders for offsetting the planes of the side rails and the bars to provide a space between the bars and the wall when the backing plate is affixed to the wall. A one-piece hook for supporting the object includes a planar body portion and a protrusion forming with said body portion a U-shaped receptacle for accepting an object to be mounted to the wall. The hook also includes an L-shaped hook retainer at one location on the body portion for removably fitting into a first slot with the upright of the "L" extending behind the bar adjacent to the slot, and a hook support finger at another location on the body portion for removably fitting into a second slot disposed below the first slot and bearing against the wall when the backing plate is affixed to the supporting structure.

15 Claims, 4 Drawing Sheets

U.S. PATENT DOCUMENTS

| | | | | |
|---|---|---|---|---|
| 5,806,826 | A | 9/1998 | Lemire | |
| 6,003,825 | A * | 12/1999 | Abernathy, Jr. | 248/478 |
| 6,152,418 | A * | 11/2000 | Panicci | 248/496 |
| 6,170,793 | B1 | 1/2001 | Clarke | |
| 6,334,602 | B1 | 1/2002 | Clarke | |
| 6,449,863 | B1 | 9/2002 | Voorhees | |
| 6,550,739 | B1 | 4/2003 | Brindisi | |
| 6,557,813 | B1 | 5/2003 | Duggan | |
| 6,663,075 | B2 * | 12/2003 | Zuller | 248/476 |
| 6,666,425 | B1 * | 12/2003 | Ferguson | 248/477 |
| 6,739,065 | B2 | 5/2004 | Hofmeister et al. | |
| 6,827,320 | B2 | 12/2004 | Yeh | |

FOREIGN PATENT DOCUMENTS

| | | |
|---|---|---|
| GB | 1513821 | 6/1978 |

* cited by examiner

ADJUSTABLE MOUNTING DEVICE

BACKGROUND OF THE INVENTION

1. Field of the Invention

The present invention relates to a device for hanging an object on a wall, and more particularly, to a device that facilitates precise placement of the object being hung.

2. Description of Background Art

Devices for hanging objects (such as pictures) on walls are well known in the prior art, and there are many such devices that are adjustable in the sense that they permit the object to be located in various positions. One such device is shown in U.S. Pat. No. 6,152,418. This device includes a bracket with a plurality of parallel, longitudinally extending flanges and a picture-hanging hook that rests on the flanges. The hook can be moved horizontally along one flange to adjust its horizontal position, and moved to a higher or lower flange to adjust its vertical position.

While this device permits the position of the picture to be adjusted, it suffers from several drawbacks. For one thing, the hook does not positively engage the flanges, which will make it subject to being dislodged during a picture-hanging operation. That is, hanging a picture typically involves moving it around until a wire or other support on the back of the picture engages a hook secured to the wall. Since the hook in U.S. Pat. No. 6,152,418 merely rests on the flanges, it will be prone to moving, or even being completely dislodged, as the picture is maneuvered into position. This problem will be exacerbated with large and/or heavy pictures. (The hook might be dislodged from the flanges in at least two ways: the back of the picture could engage the hook from below and lift it out of the flange on which it is positioned, or the hook could slide off either end of the flange while the picture is being maneuvered.) A related drawback is that the picture wire could engage the top flange, since the flanges protrude from the wall to support the hook. In addition to those operational shortcomings, the device would be relatively difficult, and therefore expensive, to make since it appears to require a complicated mold to make the bracket with integral flanges.

What is needed is a convenient to use adjustable mounting device that permits an object to be precisely located on a wall, or easily moved if the original location is later deemed unsatisfactory. The device should be capable of being cheaply manufactured and therefore inexpensive for the consumer.

SUMMARY OF THE INVENTION

In view of these and other shortcomings of known mounting devices, the present invention provides a new adjustable mounting device that can be utilized for hanging a conventionally constructed object like a picture from a structure such as a wall and adjusting the position of the object both vertically and horizontally.

It is another object of the present invention to provide a new adjustable mounting device that can be easily and efficiently manufactured and marketed.

It is a further object of the present invention to provide a new adjustable mounting device of a durable and reliable construction.

A still further object of the present invention is to provide a new adjustable mounting device that is capable of low-cost manufacture with regard to both materials and labor, and that accordingly is capable of being sold for a reasonable price to consumers, thereby making such mounting devices widely available.

In its broadest aspects the present invention is a device for hanging an object on a supporting structure, the device comprising a backing plate having a plurality of bars extending between side rails and forming slots between the bars, the backing plate including structure for enabling the backing plate to be affixed to the supporting structure, and a hook for supporting the object, the hook including a body portion and a protrusion forming with the body portion a U-shaped receptacle for accepting an object to be mounted to the supporting structure, a hook retainer at one location on the body portion for removably fitting into a first slot and extending behind at least one of the bars adjacent to the slot, and a hook support at another location on the body portion for removable fitting into a second slot disposed below the first slot when the backing plate is affixed to the supporting structure.

In accordance with more specific aspects of the invention, the backing plate and the hook are each made from a single piece of material. The device is particularly adapted for hanging an object on a planar wall, wherein the side rails are co-planar and the bars are co-planar, with the backing plate including offset shoulders for offsetting the planes of the side rails and the bars to provide a space between the bars and the wall when the side rails are in contact with the wall, and wherein the body portion is planar and the retainer is L-shaped with the upright of the "L" being planar and parallel to the plane of the body portion for extending into the space between the bars and the wall. The device can also include an adhesive on said side rails for temporarily holding said backing plate on the wall prior to being more securely affixed thereto.

For a better understanding of these and other objects of the invention, its operating advantages and the specific objects attained by its uses, reference should be had to the accompanying drawings and description of preferred embodiments of the invention that follows.

BRIEF DESCRIPTION OF THE DRAWINGS

The present invention will be better understood from the detailed description of its preferred embodiments which follows below, when taken in conjunction with the accompanying drawings, in which like numerals refer to like features throughout. This brief identification of the drawing figures will aid in understanding the detailed description that follows.

DETAILED DESCRIPTION OF THE PREFERRED EMBODIMENTS

Figure 1:
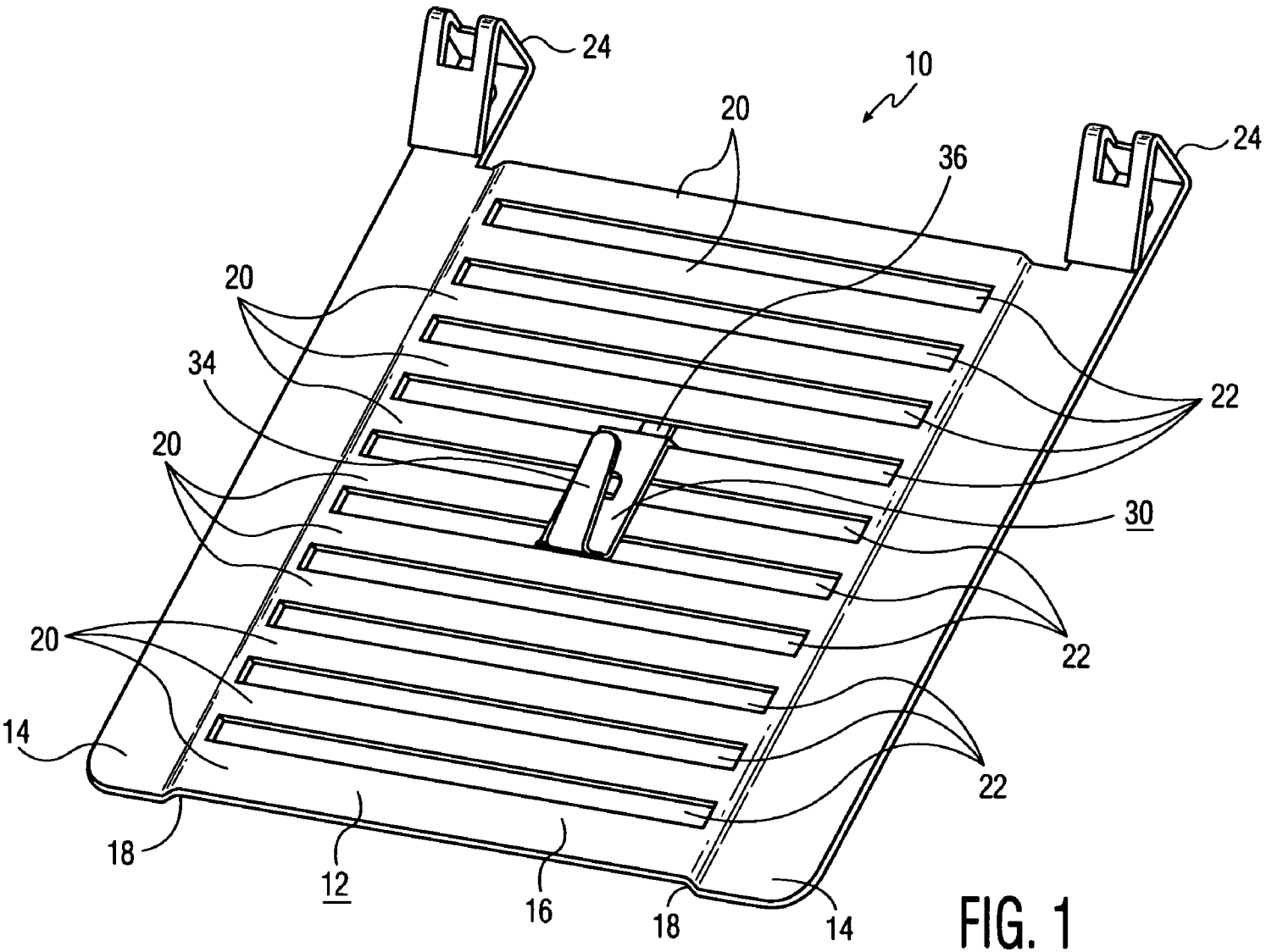
FIG. 1 is an isometric illustration of an adjustable mounting device according to one embodiment of the present invention.

Before explaining particular embodiments of the present invention in detail, it is to be understood that the invention is not limited to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 2:
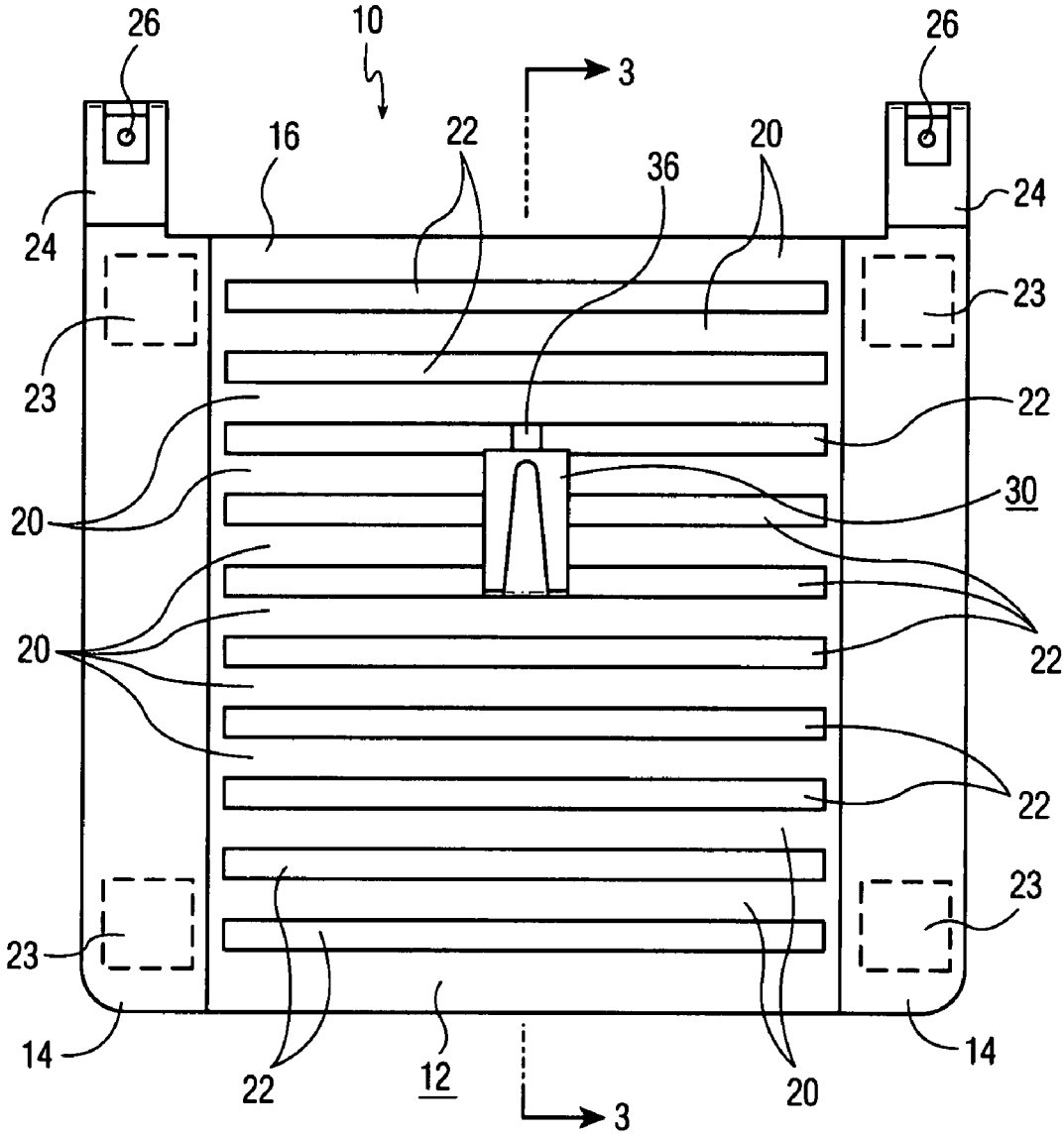
FIG. 2 is a front plan view of the mounting device shown in FIG. 1.

Referring now to FIGS. 1 and 2, the adjustable mounting device 10 according to the present embodiment includes a backing plate 12 that has two side rails 14 and a center section 16. The center section includes offset shoulders 18 that raise the center section 16 slightly relative to the side rails 14 for a purpose described later. The center section 16 comprises a series of bars 20 connecting the side rails 14. The bars 20 are spaced apart to form slots 22 running between the side rails 14. An adhesive is applied to regions 23 (not shown in FIG. 1) generally at the corners of the backing plate 12 on its rear side (as viewed in FIG. 2), for a purpose explained below. It will be appreciated that the backing plate 12 can advantageously be constructed by stamping and forming a single piece of sheet metal, although the invention is obviously not limited to any particular manner of construction. If the backing plate is stamped from sheet metal, it will facilitate formation of the hangers 24, used with mounting holes 26 for attaching the backing plate to a mounting structure such as a wall, as described below. More specifically, the device can be formed by stamping from a single piece of sheet metal a blank with slots between two opposing sides. In the same or different step, the offset shoulders 18 can be formed. The blank can be made with legs extending from two ends of the side rails 14, and the legs can be bent into the desired shape to form the hangers 24.

Figure 3:
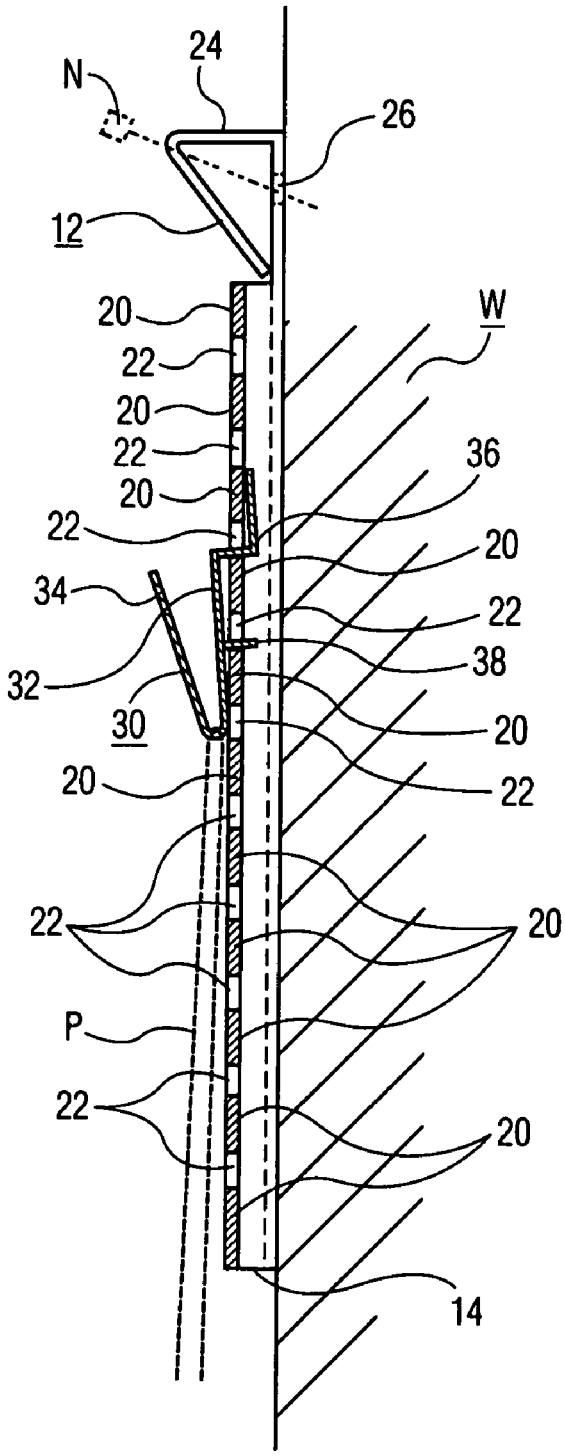
FIG. 3 is a cross-section taken through line 3-3 in FIG. 2.
Figure 4:
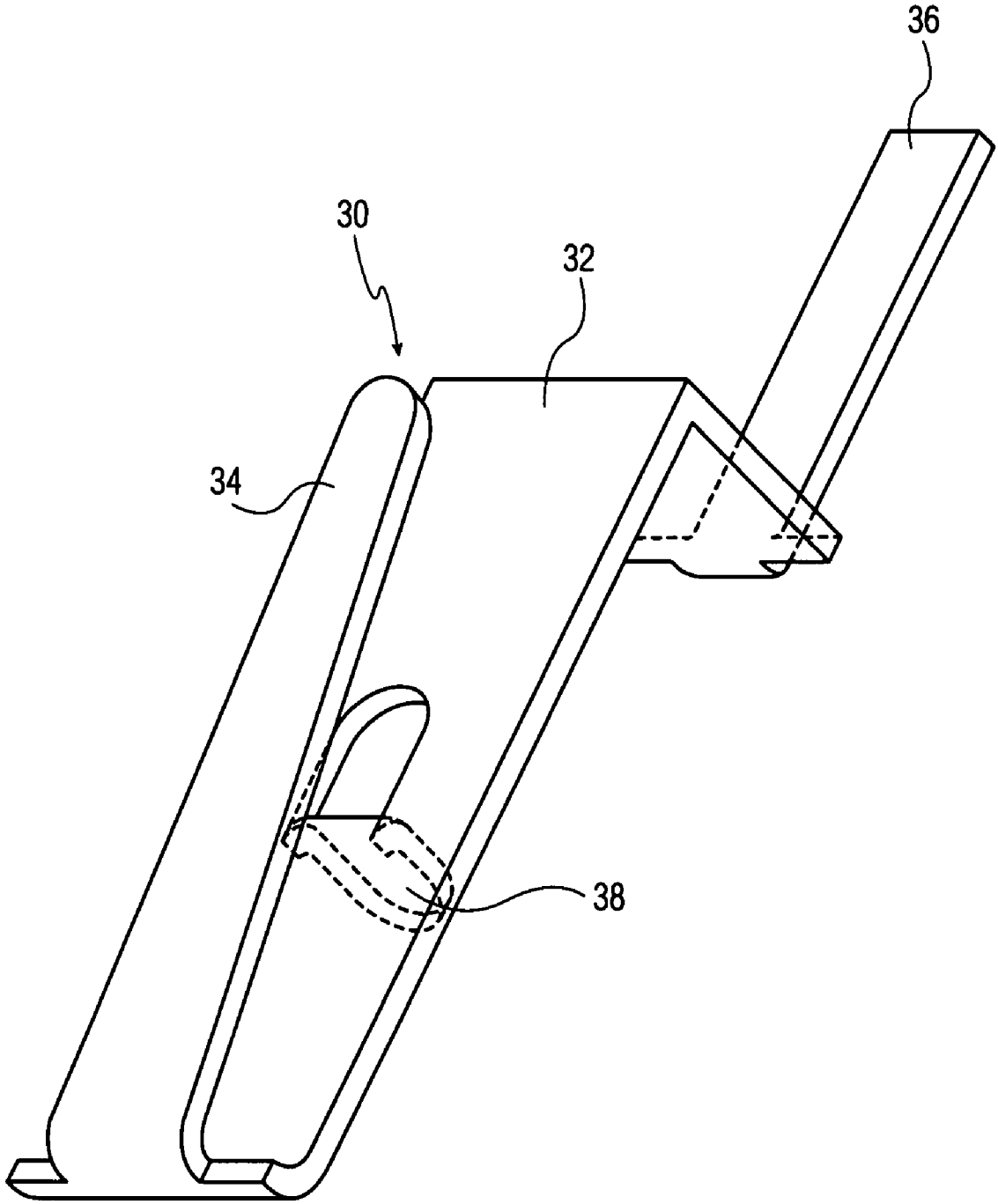
FIG. 4 is an isometric illustration of the details of a hook used in the embodiment shown in FIGS. 1 to 3.

As shown in more detail in FIGS. 3 and 4, the mounting device 10 also includes a hook 30 that is received in the slots 20. The hook 30 includes a main body portion 32 with a protrusion 34 on one side that forms a generally U-shaped receptacle with the main body 32. There is an L-shaped hook retainer 36 at one end of the hook 32 and a hook support finger 38 at the other end of the hook. The retainer 36 fits into one of the slots 22, as shown in FIG. 3, to retain the hook in place on the backing plate 12. The supporting finger 38 fits into another slot 22 to provide the main vertical support for the hook when it is in use. The hook is most conveniently manufactured by stamping and forming a single piece of sheet metal.

The manner of using the adjustable mounting device 10 is best understood by reference to FIGS. 1 to 3. Typically, a user has in mind a place on a wall W where he or she wants to locate the object to be hung. With the present invention, embodied in a device such as that described above, the user will attach the backing plate 12 to the wall W with the slots extending horizontally using nails N (shown in phantom in FIG. 3) hammered into the wall through the hangers 24 and mounting holes 26. The adhesive areas 23 assist in holding the backing plate at the desired location while the nails are driven into the wall. In a preferred embodiment, the adhesive is strong enough to hold the backing plate in place temporarily while it is being positioned, without damaging the finish on the wall. The hangers 24 provide two openings and provide access to the holes 26 through which the nails extend before penetrating the wall, thus assisting in positioning the nails at a suitable angle to the wall to provide optimum support for the backing plate when the object is hung. It will also be appreciated that the hangers 24 form extensions of the side rails 14, thus positioning them away from the backing plate 12 to make it less likely that the backing plate will be damaged when hammering in the nails. Contrast this with the arrangement shown in U.S. Pat. No. 6,152,418, in which the flanges are proximate to the nail holes, thus increasing the likelihood that flanges could be damaged when the bracket is nailed to the wall.

After the backing plate 12 is in place on the wall W, the L-shaped retainer 36 is inserted into one of the slots 22 and the supporting finger 38 fits into another of the slots 22. In the present embodiment, the side rails 14 are co-planar for mounting to the planar wall W, and the bars 20 are also co-planar, with the shoulders 18 offsetting the planes of the side rails and the bars. This provides a space between the bars and the wall when the backing plate is mounted with the side rails in contact with the wall. Likewise, the body portion 32 of the hook 30 is planar, as is the upright of the "L" of the retainer 36, which is parallel to the plane of said body portion 32. The hook retainer 36 thus extends into the space between the bars 20 and the wall W. In addition, the spacing between the bars and the wall permits the hook support finger 38, which in this embodiment is also planar and perpendicular to the body portion, to extend sufficiently through the slot 22 to securely support the hook 30 under the weight of the object being hung.

The hook is now ready to hang a picture or other object from the wall. This is represented in FIG. 3, which depicts a picture wire P that fits into the U-shaped receptacle formed by the main body 32 and the protrusion 34. FIG. 3 also illustrates the manner in which the planar upright of the L-shaped retainer extends upward behind the bar adjacent the slot through which it was inserted to retain the hook under the weight of the object being hung, with the support finger bearing against the wall, so that the hook 30 is held securely in place. The hook is also supported vertically at two points, the horizontal portion of the L-shaped retainer and the supporting finger, which increases the load bearing capacity of the device, as compared to devices like that shown in U.S. Pat. No. 6,152,418. Accordingly, longer bars can be used (because the weight of the object being hung is distributed between two bars), thus affording the hook a greater range of motion in positioning the object.

It will be immediately appreciated that the hook 30 can be moved either horizontally along the slots supporting it, or it can be moved vertically simply by reversing the operation by which it was inserted into the backing plate and inserting it into different slots at a different level. This enables the user to easily reposition the object being hung because it does not require removing the backing plate from the wall. In addition, it permits the picture to be more precisely located than with a conventional picture hook that is attached directly to the wall, since it can be difficult to judge the final position of the picture after it is hung just from the location of a hook secured to the wall. In addition, the hanging device of the embodiment of the invention illustrated here comprises only two separate parts, both of which can be inexpensively manufactured, and can be readily scaled to different sizes and strengths for mounting heavier or lighter objects.

The mounting device described here overcomes other disadvantages of the prior art, as well. Since the hook 30 is received in closed-end slots, the hook cannot slide off the mounting bracket. Moreover, the retainer 36 and the support 38 cooperate to more positively secure the hook 30 to the backing plate 12, rather than retaining the hook solely by the force of gravity. Accordingly, the hook will not be dislodged while a picture or other object is maneuvered into position. Finally, there are no protruding parts for the picture wire to engage and interfere with the hanging operation.

While preferred embodiments of the invention have been depicted and described, it will be understood that various changes and modifications can be made other than those specifically mentioned above without departing from the spirit and scope of the invention, which is defined solely by the claims that follow.

In this respect, it is to be understood that the invention is not limited in its application to the details of construction and to the arrangements of the components set forth in the above description or illustrated in the drawings. The invention is capable of other embodiments and of being practiced and carried out in various ways. For example, the hangers that form a part of the described embodiment can have other configurations more suited to accepting screws driven into the wall at a right angle, or the hangers can be omitted altogether and replaced by holes at desired locations in the backing plate. Nor do the backing plate and hook need to be stamped and formed from sheet metal. Other manufacturing methods that provide a device within the following claims are within the scope of the present invention. Also, it is to be understood that terms such as "vertical," "horizontal," and "behind" are used to facilitate the description of the embodiment shown in the drawings, and should not be regarded as limiting in any way.

As such, those skilled in the art will appreciate that the conception, upon which this disclosure is based, may readily be utilized as a basis for the designing of other structures, methods and systems for carrying out the several purposes of the present invention. It is important, therefore, that the following claims be regarded as including such equivalent constructions insofar as they do not depart from the spirit and scope of the present invention.

What is claimed is:

1. A device for hanging an object on a planar wall, the device comprising:

a backing plate having a plurality of co-planar bars extending between co-planar side rails with slots between said bars, said backing plate including structure for enabling said backing plate to be affixed to the wall with said side rails in contact with the wall to provide a space between said bars and the wall; and a hook for supporting the object, said hook including a body portion and a protrusion forming with said body portion a U-shaped receptacle for accepting an object to be mounted to the wall, a first hook retainer at one location on said body portion for removably fitting into a first said slot and extending behind at least one of said bars adjacent to said slot and into the space between said bars and the wall, and a second hook retainer at another location on said body portion for removably fitting into a second said slot disposed below said first said slot when said backing plate is affixed to the wall.

2. A device as in claim 1, wherein said backing plate and said hook are each made from a single piece of material.

3. A device as in claim 2, wherein said backing plate and said hook are formed from sheet metal.

4. A device as in claim 1, wherein:

said backing plate includes offset shoulders for offsetting the planes of said side rails and said bars to provide the space between said bars and the wall when said side rails are in contact with the wall; and said body portion is planar and said first hook retainer is L-shaped with the upright of the "L" being planar and parallel to the plane of said body portion for extending into the space between said bars and the wall.

5. A device as in claim 4, wherein said second hook retainer comprises a hook support having a supporting finger perpendicular to said body portion.

6. A device as in claim 4, further including an adhesive on said side rails for temporarily holding said backing plate on the wall prior to being more securely affixed thereto.

7. A device as in claim 6, further including hangers forming extensions at ends of said side rails for accepting nails therethrough to securely affix said backing plate to the wall.

8. A device as in claim 4, wherein said first hook retainer and said body portion form an angle that is substantially 90°.

9. A device as in claim 4, wherein said "L" shape of said first hook retainer has a base joining said leg and said body portion, said base and said leg being joined at an angle that is substantially 90°.

10. A device as in claim 1, wherein said first hook retainer is joined to said body portion at a top edge thereof and said protrusion is joined to said body portion at a bottom edge thereof.

11. A device as in claim 10, wherein said second hook retainer is joined to said body portion at a location intermediate said top and bottom edges.

12. A device as in claim 11, wherein said second hook retainer comprises a single supporting finger extending from said body portion.

13. A device as in claim 1, wherein said second hook retainer comprises a single supporting finger extending from said body portion.

14. A device as in claim 1, wherein said second hook retainer bears against a top edge of said bar adjacent said second slot.

15. A device as in claim 1, wherein said body portion is planar and said first hook retainer joins said body portion at a top edge thereof and is narrower than said body portion in a direction parallel to the plane of thereof.

* * * * *